United States Patent [19]

Winyard et al.

[11] Patent Number: 4,862,590

[45] Date of Patent: Sep. 5, 1989

[54] RETRACTABLE BLADE KNIFE

[75] Inventors: Frank Winyard, Lower Templestowe; Gordon Bremner, Olinda; Cvetan Petroff, Kew, all of Australia

[73] Assignee: McPherson's Limited, Australia

[21] Appl. No.: 119,148

[22] Filed: Nov. 10, 1987

[30] Foreign Application Priority Data

Nov. 12, 1986 [AU] Australia ..... PH8907

[51] Int. Cl.[4] ..... B26B 3/06

[52] U.S. Cl. ..... 30/161; 30/138

[58] Field of Search ..... 30/161, 162, 151, 138

[56] References Cited

U.S. PATENT DOCUMENTS

| | | | |
|---|---|---|---|
| 1,507,043 | 9/1924 | Blow | 30/138 |
| 2,337,158 | 5/1943 | Frank . | |
| 2,700,819 | 12/1952 | Mason . | |
| 2,744,320 | 5/1956 | Palermo . | |
| 3,676,961 | 7/1972 | Jackson . | |
| 3,846,909 | 11/1974 | Clarke . | |
| 4,761,882 | 8/1988 | Silverstein | 30/162 |

FOREIGN PATENT DOCUMENTS 2161737 1/1986 United Kingdom .

*Primary Examiner*—Frank T. Yost
*Assistant Examiner*—Willmon Fridie, Jr.
*Attorney, Agent, or Firm*—Lerner, David, Littenberg, Krumholz & Mentlik

[57] ABSTRACT

A retractable blade knife having a self-sharpening facility which can be selectively rendered inoperable. The sharpener is spring biased in an upward direction so as to be urged into engagement with the cutting edge of a knife blade, and manually operable release means is provided to permit the sharpener to be held in an inoperable position. An assembly of which the sharpener forms part also functions as stop means which positively prevents movement of the knife blade into its extended position. Such extension is possible only upon operation of the release means, but that is only necessary during initial outward movement of the knife blade. The sharpener is arranged to sharpen the cutting edge of the blade up to the tip of the blade. Positive locking means is provided to prevent inward movement of the blade when working under load in the extended position.

27 Claims, 3 Drawing Sheets

RETRACTABLE BLADE KNIFE

BACKGROUND AND FIELD OF THE INVENTION

This invention relates to knives of the kind having a blade which is movable between an extended or operative position and a retracted or inoperative position. It is usual for the blade to be contained within a handle of the knife when retracted, and the invention will be hereinafter described with particular reference to that form of knife.

Retractable blade knives of the foregoing kind are generally constructed so that a worn or damaged blade can be removed and replaced by a new blade. Example constructions of that kind are disclosed by U.S. Pat. Nos. 3,577,637, 3,593,417 and 4,242,795. It is not convenient to sharpen the blade in knives of the foregoing kind and as a result blade replacement may occur or be required at relatively short intervals of time.

It has been proposed in the past to provide a retractable blade knife with a self-sharpening facility, and U.S. Pat. No. 1,890,506 (Frank) discloses that particular construction. The Frank knife is not known to have been manufactured in commercial quantities, and is distinguished from the other retractable blade knives referred to above in that the blade is not readily replaced. It has the further disadvantage in that retraction of the blade extends rather than reduces the overall size of the knife. The Frank knife is also not satisfactory because the self-sharpening facility does not sharpen the entire length of the blade cutting edge, and in particular does not and cannot sharpen the very tip of the blade which is often the most used portion of the blade.

Another common problem with knives of the foregoing kind is that the blade is not firmly restrained in the extended position so that pressure on the blade during use can cause unintentional retraction of the blade.

It is an object of the present invention to provide a knife of the foregoing kind which has an effective self-sharpening facility. It is another object to provide such a knife having means to prevent inadvertent extension of the blade. It is a further object to provide such a knife with means whereby the blade is positively retained in the extended position.

BRIEF SUMMARY OF THE INVENTION

According to one aspect of the present invention, there is provided a retractable blade knife including, a hollow handle, a blade opening at a front end of said handle, a blade carrier mounted within said handle for movement between a rest position at which a blade connected to said carrier is contained within said handle and a forward position at which the said blade is projected through said opening beyond said handle front end, actuator means connected to said carrier and being operable to cause said movement thereof, a blade sharpener located within said handle adjacent said opening and being mounted for movement relative to said handle, biasing means urging said sharpener towards a stop position at which the sharpener prevents movement of a said blade forwardly through said opening, release means operable to move said sharpener away from said stop position and into a release position at which a said blade is able to be moved forwardly through said opening, and said sharpener is engageable with the cutting edge of a said blade so as to sharpen that edge as said blade is moved through said opening.

According to another aspect of the invention, there is provided a retractable blade knife including, a hollow handle, a blade opening at a front end of said handle, a blade carrier mounted within said handle, a blade removably connected to said carrier, said carrier being movable relative to said handle between a rest position at which said blade is contained within said handle and a forward position at which said blade is projected through said opening beyond said handle front end, actuator means operable to cause said carrier movement, a blade sharpener located within said handle adjacent said opening and being operable to engage the cutting edge of said blade so as to sharpen that edge during movement of said blade with said carrier, said sharpener including sharpening means which is engageable with said cutting edge and which is located forwardly of the front end of said blade when said carrier is in said rest position, and release means connected to said sharpener and being selectively operable to render said sharpener inoperable.

According to still another aspect of the invention, there is provided a retractable blade knife including, a hollow handle, a blade opening at a front end of said handle, a blade carrier mounted within said handle for movement relative thereto, connecting means whereby a blade can be connected to and removed from said carrier, said carrier being movable between a rest position at which a blade connected to said carrier is contained within said handle and a forward position at which the said blade is projected through said opening beyond said handle front end, actuator means operable to cause said carrier movement, a blade sharpener located within said handle adjacent said opening and being operable to engage the cutting edge of the said blade so as to sharpen that edge during movement of said blade through said opening, and sharpener release means which is selectively operable to render said sharpener inoperable.

According to yet another aspect of the invention, there is provided a retractable blade knife including, a hollow handle, a blade opening at a front end of said handle, a blade carrier mounted within said handle for movement between a rest position at which a blade connected to said carrier is contained within said handle and a forward position at which the said blade is projected through said opening beyond said handle front end, actuator means operable to cause said carrier movement, a blade sharpener located within said handle adjacent said opening and being engageable with the cutting edge of a said blade so as to sharpen that edge as said blade is moved with said carrier, and stop means mounted on said handle for movement between a stop position at which it is operative to prevent movement of a said blade forwardly through said opening and a release position at which it is not so operative, and release means which is operable to move said stop means from said stop position to said release position.

According to a further aspect of the invention, there is provided a retractable blade knife including, a hollow handle, a blade opening at a front end of said handle, a blade carrier mounted within said handle for movement between a rest position at which a blade connected to said carrier is contained within said handle and a forward position at which the said blade is projected through said opening beyond said handle front end, actuator means operable to cause said carrier movement, a blade sharpener located within said handle adjacent said opening and being operable to engage the cutting edge of the said blade so as to sharpen that edge during movement of said blade through said opening, and releasable locking means which is operable to prevent movement of said carrier out of said forward position.

The blade sharpener is arranged so that when it engages the cutting edge of a blade it automatically sharpens that blade as a consequence of movement of the blade into or out of the knife handle. In a preferred embodiment hereinafter described, the sharpening operation is most effective during withdrawal of the blade into the handle, and means is provided to enable that sharpener to be held inoperative during at least part of the movement of the blade into its extended operative position.

BRIEF DESCRIPTION OF THE DRAWINGS

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

In the drawings.

DETAILED DESCRIPTION OF A PREFERRED EMBODIMENT

Figure 5:
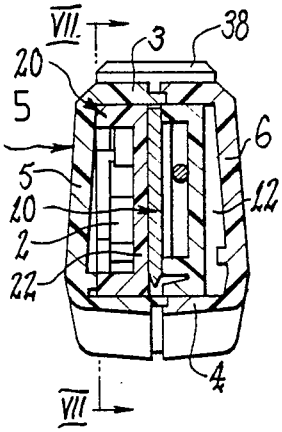
FIG. 5 is a cross-sectional view taken along line V—V of FIG. 1.

According to the example form shown in the drawings, the knife includes an elongate handle 1 having a passage 2 (FIGS. 5 and 6) extending lengthwise therein. That passage 2 is defined between an upper wall 3, a lower wall 4, and two side walls 5 and 6, and extends from a rear end portion 7 of the handle 1 to a front end wall 8. An opening 9 (FIG. 6) is provided through the front end wall 8 to permit movement of a blade 10 into and out of the handle passage 2. Preferably, that opening 9 is in the form of a narrow slot extending between upper and lower sides of the handle 1 and which is dimensioned to allow passage of the knife blade 10 with little clearance. That is, it is preferred that the opening 9 is dimensioned so as to at least minimise lateral movement of the blade 10 relative to the handle 1, and preferably also provide a support which is engageable by the upper edge 11 of the blade 10 when the knife is in use. The rear end portion 7 of the handle 1 is removable in the construction shown to enable access to the interior of the handle 1. Removal of that end portion 7 may be employed to enable exchange of the knife blade 10 if it becomes worn or damaged. Also, the handle 1 may include a spare blade storage compartment 12 (FIG. 5) which is accessible as a consequence of removing the end portion 7. The compartment 12 may be adapted to contain a single spare blade (not shown), or a plurality of such blades.

Figure 3:
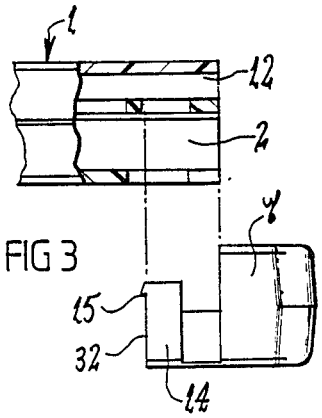
FIG. 3 is a partially sectioned and exploded view of the rear end portion of the knife shown in FIG. 1.
Figure 4:
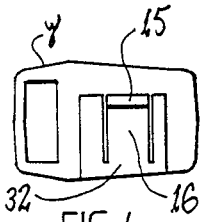
FIG. 4 is an end view of the removable end portion shown in FIG. 3.

In the arrangement shown, the end portion 7 is slidably engaged with the main body 13 of the handle 1 so as to be relatively movable in a direction transverse to the longitudinal axis of the handle 1. Keying ribs 14 (FIGS. 1 and 3) provided on the end portion 7 slidably engage within complementary slots formed in the handle main body 13 so as to hold the end portion 7 against endwise removal from the main body 13. Snap engaging means comprising a detent 15 (FIGS. 3 and 4) may be provided on the end portion 7 for cooperation with the main body 13 so as to resist inadvertent dislodgement of the end portion 7 from the main body 13. As best seen in FIG. 4, the detent 15 is at the end of a flexible arm 16 formed integral with the end portion 7.

Figure 1:
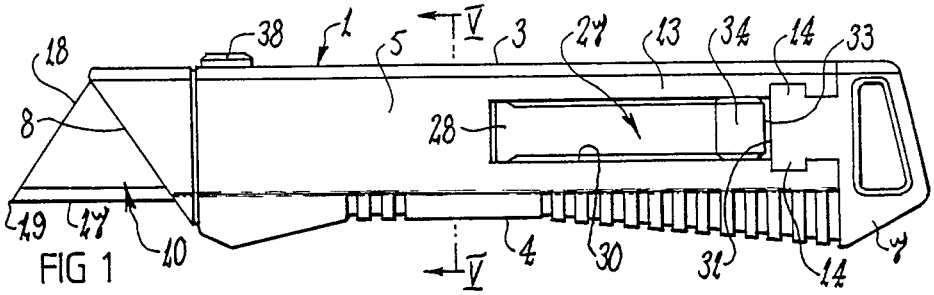
FIG. 1 is a side elevational view of one form of retractable blade knife incorporating an embodiment of the invention.
Figure 2:
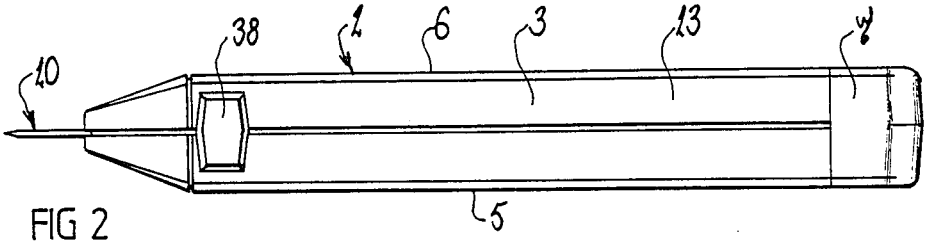
FIG. 2 is a top plan view of the knife shown in FIG. 1.

The blade 10 may be of any suitable form, but is generally of plate-like form having a substantially straight cutting edge 17. It is preferred that a front edge 18 and the upper edge 11 of the blade 10 are also substantially straight and that the front edge slopes upwardly and rearwardly from a tip 19 at its junction with the cutting edge 17. In such a case, it is also preferred that the front wall 8 of the knife handle 1 slopes downwardly and rearwardly as shown so as to expose a substantial part of the blade cutting edge 17 when the blade 10 is extended (FIG. 1). It is also preferred that the blade 10 is double ended so as to be reversible.

A blade carrier 20 (FIG. 7) is mounted within the knife handle passage 2 for sliding movement towards and away from the front wall 8. That carrier 20 can be of any suitable form such as to provide support for a blade 10, and any appropriate releasable connection can be provided between the blade 10 and the carrier 20 to ensure that the blade 10 moves with the carrier 20. In the construction shown, that connection includes a plurality of laterally projecting pins 21 on a side surface 22 of the carrier 20, each of which neatly engages within a respective hole 23 formed through a portion 24 of the blade 10 which overlies the carrier surface 22. Confinement of the blade 10 within the handle 1 may be such as to prevent the carrier pins 21 disengaging from the blade holes 23.

Exchange of a blade 10 may be effected by sliding the carrier 20 and connected blade 10 out of the handle 1 through the rear end thereof. Such removal is of course prevented while the rear end portion 7 of the handle 1 remains in place.

Figure 7:
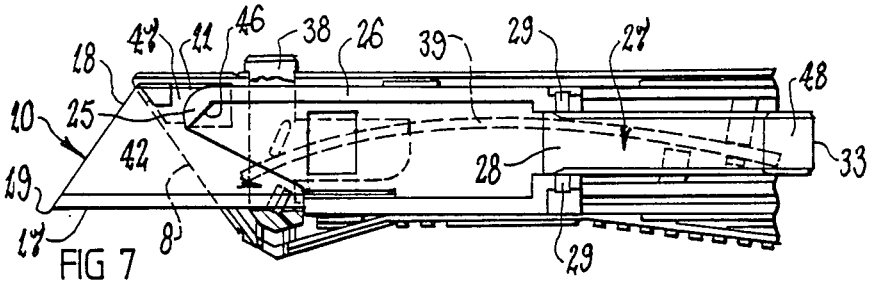
FIG. 7 is a sectional view taken along line VII—VII of FIG. 5.
Figure 8:
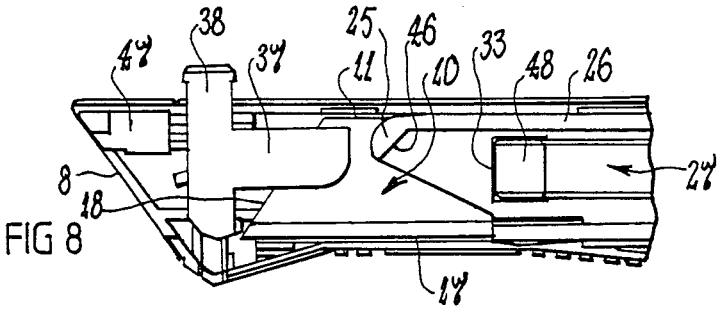
FIG. 8 is a view similar to FIG. 7 but showing the blade fully retracted.

The carrier 20 is movable between two extreme positions. One is a rest position as shown in FIG. 8, and in that position the blade 10 is fully contained within the handle 1. The other is a forward position as shown in FIG. 7, and in that position the blade 10 has been projected through the opening 9 so as to extend beyond the handle front wall 8. That is, the blade 10 is positioned so as to be operative.

Figure 12:
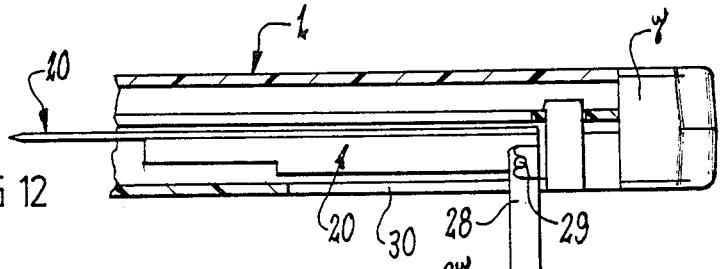
FIG. 12 is a part sectional view showing the manner of actuation of the blade carrier of the knife of FIG. 1.
Figure 16:
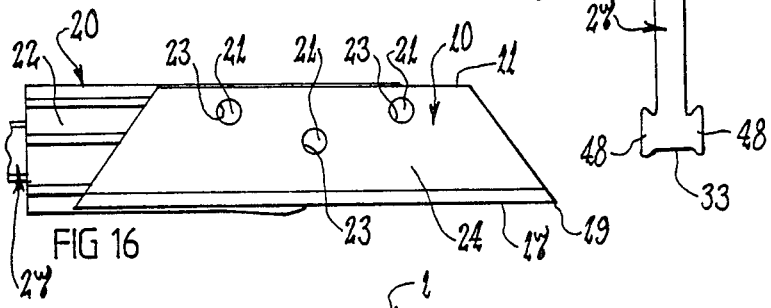
FIG. 16 is a view taken along line XVI—XVI of FIG. 14.
Figure 13:
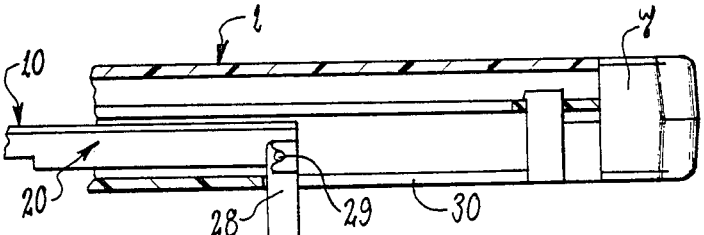
FIG. 13 is a view similar to FIG. 12 but showing the blade carrier moved to its forwardmost position.
Figure 14:
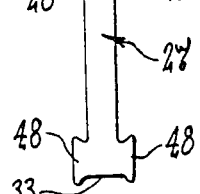
FIG. 14 is a view similar to FIG. 13 and showing the blade actuator in its stored position.
Figure 14:
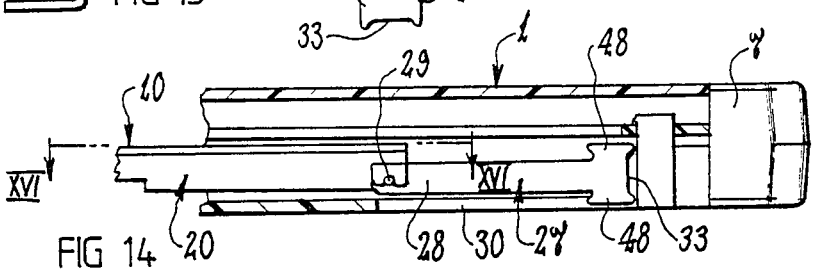

Movement of the carrier 20 may be effected through any suitable actuator means, but in the construction shown that actuator means comprises a lever 27 which is pivotally connected at an inner end 28 to the carrier 20 for relative movement between an operative position (FIGS. 12 and 13) and a stored position (FIG. 14). Also, the lever 27 is preferably arranged to be accessible at the side wall 5 of the handle 1.

According to the arrangement shown, the lever 27 is pivotally connected to the carrier 20 so that it can be swung about a pivot 29 (FIG. 12) having its axis extending between the upper and lower walls 3 and 4 of the handle 1. An elongate opening 30 is provided in the side wall 5 to accommodate the lever 27 when it is in the stored position. The length of the opening 30 is such as to accommodate the full length of the lever 27 without substantial clearance at either end. One end 31 of the opening 30 is formed by a surface 32 (FIG. 3) of the handle end portion 7. The pivoted inner end 28 of the lever 27 is adjacent the rear end portion 7 of the handle 1 when the lever 27 is in its stored position and the knife blade 10 is retracted (FIG. 8). The outer or free end 33 of the lever 27 is located towards the front end of the handle 1 under those circumstances, and the lever 27 is substantially contained within the opening 30. A raised finger engageable portion 48 of the lever 27 is accessible to permit the lever 27 to be pulled outwards about the pivot 29 to adopt the operative position as shown in FIG 13.

When it is desired to extend the blade 10, the lever 27 is pivoted laterally outwards from the handle 1 and is pushed forward so that the carrier 20 and connected blade 10 also move forward. The blade 10 is thereby projected through the front wall opening 9 of the handle 1 to adopt the extended position as shown in FIG. 1. At that time the pivoted inner end 28 of the lever 27 is at the forwardmost end of the opening 30 in the handle side wall 5 and the lever 27 can be swung inwards to be again accommodated in that opening 30. The relative disposition of the lever ends 28 and 33, however, is now the reverse of that existing when the blade 10 is retracted.

Positive locking means is provided to prevent the blade 10 being inadvertently pushed back into the handle 1 from the extended position when the blade 10 is subjected to endwise pressure in use. In the construction shown, that locking means includes the lever 27 and a cooperative abutment surface formed by the end 31 of the handle opening 30. That is, when the lever 27 is accommodated within the opening 30 as shown in FIG. 14, the outer end 33 of the lever 27 is arranged in opposed relationship to that abutment surface so as to positively resist rearward movement of the carrier 20. Pivotal movement of the lever 27 out of the opening 30 releases that locking arrangement by removing the lever end 33 from a position at which it can engage the abutment surface.

Stop means is provided to prevent inadvertent movement of the blade 10 into the extended position. That may include a movable stop member located within the handle 1 which is engageable with the blade 10 or a cooperable part of the carrier 20. That is, when the carrier 20 is at the rest position, that stop member is arranged to be engaged by the blade 10 or the carrier 20 such as to prevent forward movement of the carrier 20 beyond a particular position.

In the preferred construction shown, the stop means is formed by cooperable parts of a blade sharpener 34 and the carrier 20, but other arrangements are possible. The sharpener 34 is located within the handle 1 adjacent the front wall 8, and its function and construction will be further described below. The sharpener 34 includes a body member 35 and the stop means part of the sharpener 34 is formed by a lateral projection 36 provided on a rear end portion of an arm 37 which is connected to and extends rearwardly from the body member 35. The cooperable part of the carrier 20 is formed by the front end portion 25 of a laterally projecting lip 26 formed along the upper side of the carrier 20.

When the carrier 20 is at the rest position as shown in FIG. 8, the carrier stop part 25 is located rearwardly of the sharpener stop part 36. Forward movement of the carrier 20 results in the stop part 25 engaging the stop part 36, and further forward movement is thereby prevented. At that time, the blade 10 has not been projected through the opening 9.

Figure 9:
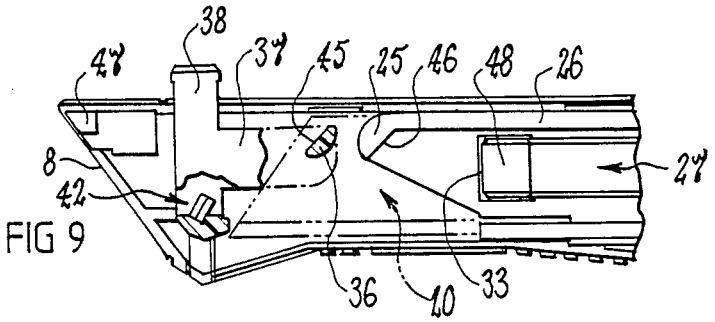
FIG. 9 is a view similar to FIG. 8 but with parts omitted for convenience of illustration.
Figure 10:
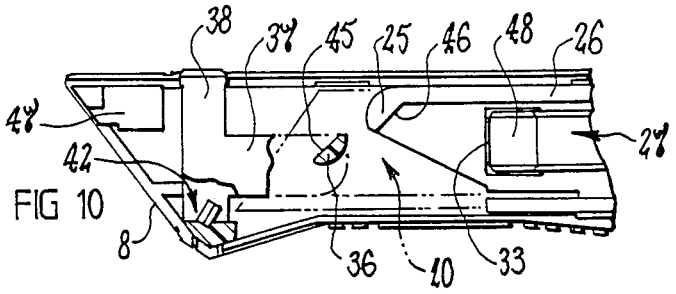
FIG. 10 is a view similar to FIG. 9 but showing the stop means rendered inoperative.

Release means is provided whereby the stop means can be selectively rendered inoperable. In the construction shown, that release means is connected to the sharpener 34 so as to be operable to move the stop part 36 out of the path of the carrier stop part 25 and thereby permit extension of the blade 10. That release means includes a button 38 which is accessible at the upper side of the handle 1 and which is spring biased into an upper stop operative position as shown in FIG. 9. Depression of the button 38 against the influence of the biasing spring 39 is effective to move the stop part 36 into its inoperative position as shown by FIG. 10.

Figure 6:
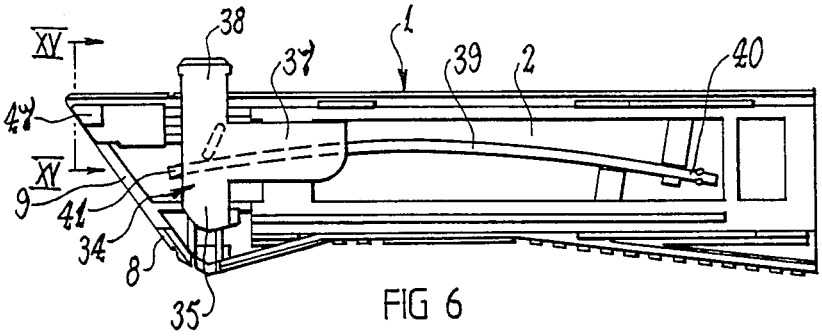
FIG. 6 is a longitudinal sectional view of the knife shown in FIGS. 1 and 2, but with parts omitted for convenience of illustration.

The button biasing spring 39 is preferably formed by a resilient arm as shown in FIG. 6 which extends lengthwise of the handle 1, and has one end 40 fixed to the handle 1 and its opposite end 41 attached to the sharpener 34. The spring end 40 is preferably secured to the handle adjacent the rear end thereof as shown. The arrangement is such that the spring 39 normally urges the sharpener 34 and connected button 38 in an upward direction and any appropriate means may be provided to limit such upward movement. Furthermore, the sharpener 34 and/or button 38 may cooperate with appropriate guide means provided on or within the handle 1 so as to be confined to a particular path of movement.

Sharpening means 42 is provided on the sharpener 34 and is arranged so as to be operative to automatically sharpen the cutting edge 17 of the blade 10. In the arrangement shown, the sharpening means 42 is not engageable with the blade cutting edge 17 when the button 38 is depressed, but is so engageable when the button 38 is allowed to move upwards under the influence of its biasing spring 39. It is an important feature of the construction shown that the tip 19 of the blade 10 is located rearwards of the sharpening means 42 when the blade 10 is fully retracted.

With the foregoing arrangement, it is necessary to depress the release button 38 to permit extension of the blade 10 and as a consequence the blade 10 does not contact the sharpening means 42, at least during the initial part of that extension movement. If the button 38 is released during the course of that movement, there may be sharpening engagement, but that is not essential nor is it preferred. When the blade 10 is fully extended, the button 38 is released so that the sharpening means 42 is moved into engagement with part of the blade cutting edge 17 which is located within the handle 1 and is therefore not normally operative.

Retraction of the blade 10 does not require depression of the release button 38. Consequently, the sharpening means 42 remains in engagement with and sharpens the cutting edge 17 during movement of the blade 10 back into the handle 1. Furthermore, that sharpening is effected up to the very tip 19 of the blade 10 because the blade 10 is moved rearwardly beyond the sharpening means 42 when adopting the fully retracted position. Such full retraction has the affect of automatically conditioning the stop means to be operative, because the spring 39 urges the sharpener 34 into its uppermost position when the blade 10 moves clear of the sharpening means 42.

Figure 11:
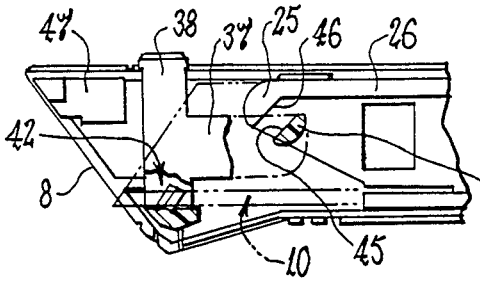
FIG. 11 is a view similar to FIG. 10 and showing the blade carrier in a forward position.

As will be apparent from FIGS. 9 to 11, the stop part 36 is provided with a ramp surface 45 and the stop part 25 is provided with a ramp surface 46. The ramp surfaces 45 and 46 may be flat or curved as required. When the stop part 25 is located forwardly of the stop part 36, the ramp surfaces 45 and 46 are arranged in opposed relationship as shown by FIG. 11. Rearward movement of the carrier 20 results in those two surfaces 45 and 46 engaging with the consequence that the sharpener 34 is ramped downward against the action of the spring 39, and the carrier 20 can continue to move rearward. The stop means is thereby automatically rendered inoperative during rearward movement of the carrier. Other arrangements could be adopted to achieve the same result.

The sharpening means 42 can be of any suitable form. In the construction shown, it comprises a device having a pair of cutting plates 43 of tungsten carbide or other suitable material and which are relatively arranged to define a V-shaped sharpening recess 44 between them. Preferably, the plates 43 overlap to define that recess 44 and are in face to face relationship. It is further preferred that the plates 43 slope upwardly and rearwardly to facilitate a relatively smooth sharpening action during retraction of the blade 10.

Since the two plates 43 are out of lateral alignment, only one will be engaged by the blade 10 during the final part of the retracting movement of the blade 10 over the sharpening device 42. That may cause lateral deflection of the blade 10 and consequently an absence of sharpening at one side of the blade tip. If such deflection does occur, a third blade or a rubbing member may be located opposite to the rearmost plate 43 of the pair referred to. That third blade or rubbing member can be arranged to prevent or minimise the aforementioned deflection and thereby ensure that effective sharpening of the blade 10 is carried up to the tip 19 of the blade 10.

Figure 15:
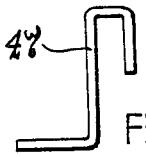
FIG. 15 is a cross-sectional view taken along line XV—XV of FIG. 6.

A channel-shaped metal insert 47 (FIGS. 6 and 15) is preferably provided at the top of the handle opening 9. That insert 47 receives an upper edge portion of the knife blade 10 and provides a rigid and wear resistant support against which the upper edge 11 of the blade 10 can bear during use and movement into and out of the handle 1.

It will be apparent from the foregoing description that the present invention provides an effective knife of the retractable blade type, particularly in the ability to prevent inadvertent extension of the blade and to also provide for self-sharpening of the blade.

Various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. A retractable blade knife including, a hollow handle, a blade opening at a front end of said handle, a blade carrier mounted within said handle for movement between a rest position at which a blade connected to said carrier is contained within said handle and a forward position at which the said blade is projected through said opening beyond said handle front end, actuator means connected to said carrier and being operable to cause said movement thereof, a blade sharpener located within said handle adjacent said opening and being mounted for movement relative to said handle, biasing means urging said sharpener towards a stop position at which the sharpener prevents movement of a said blade forwardly through said opening, release means operable to move said sharpener away from said stop position and into a release position at which a said blade is able to be moved forwardly through said opening, and said sharpener is engageable with the cutting edge of a said blade so as to sharpen that edge as said blade is moved through said opening.

2. A knife according to claim 1, wherein said sharpener includes sharpening means which is engageable with said blade edge, and said sharpening means is located forwardly of a front end of a said blade when said carrier is in said rest position.

3. A knife according to claim 2, wherein cooperable parts of said sharpener and said carrier are engageable to prevent forward movement of said carrier to a position at which said blade extends over said sharpening means.

4. A knife according to claim 3, wherein said cooperable parts do not prevent rearward movement of said carrier from said forward position to said rest position.

5. A knife according to claim 1, wherein said handle has an upper wall, a lower wall and two side walls, each of said walls extends between front and rear ends of said handle, a passage is defined between said walls, said carrier is located within said passage, and said biasing means urges said sharpener in a direction towards said upper wall.

6. A knife according to claim 5, wherein said sharpener is positioned between said stop and release positions when engaging a cutting edge of a said blade.

7. A knife according to claim 5, wherein said release means includes a button connected to said sharpener and which projects upwardly through and beyond said upper wall at least when said sharpener is in said stop position.

8. A knife according to claim 3, wherein said sharpener includes a body member and sharpening means secured to that body member, said sharpening means defining a V-shaped sharpening recess for receiving the cutting edge of a said blade, and said button is connected to said body member.

9. A knife according to claim 8, wherein said biasing means includes a spring arm which extends longitudinally of said passage and has its opposite ends connected to said handle and said body member respectively.

10. A knife according to claim 8, wherein sharpening means includes two overlapping cutter plates, and said cutter plates slope upwardly and rearwardly.

11. A knife according to claim 8, wherein one of said cooperable parts comprises an arm secured to and extending rearwardly from said body member and a lateral projection provided on a rear end portion of said arm, and the other said cooperable part is provided on a front end portion of said carrier.

12. A knife according to claim 11, wherein a ramp surface is provided on each said cooperable part, and said ramp surfaces engage during rearward movement of said carrier so as to render said cooperable parts inoperable to prevent said rearward movement.

13. A knife according to claim 8, wherein guide means is provided on said handle and cooperates with said body member to guide said body member in its movement between said stop and release positions.

14. A retractable blade knife including, a hollow handle, a blade opening at a front end of said handle, a blade carrier mounted within said handle, a blade removably connected to said carrier, said carrier being movable relative to said handle between a rest position at which said blade is contained within said handle and a forward position at which said blade is projected through said opening beyond said handle front end, actuator means operable to cause said carrier movement, a blade sharpener located within said handle adjacent said opening and being operable to engage the cutting edge of said blade so as to sharpen that edge during movement of said blade with said carrier, said sharpener including sharpening means which is engageable with said cutting edge and which is located forwardly of the front end of said blade when said carrier is in said rest position, and release means connected to said sharpener and being selectively operable to render said sharpener inoperable.

15. A knife according to claim 14, wherein stop means is operative to prevent movement of said carrier forwardly from said rest position to a position at which said sharpening means is operatively engageable with said blade edge, and said release means is operable to render said stop means inoperative.

16. A knife according to claim 15, wherein said stop means is inoperative to prevent rearward movement of said blade relative to said sharpener.

17. A knife according to claim 15, wherein said stop means is formed by cooperable parts of said sharpener and said carrier.

18. A knife according to claim 17, wherein each said part includes a ramping surface, and said ramping surfaces are engageable during rearward movement of said carrier from the forward position to the rest position thereof, and by that engagement render said stop means inoperative to prevent such rearward movement.

19. A retractable blade knife including, a hollow handle, a blade opening at a front end of said handle, a blade carrier mounted within said handle for movement relative thereto, connecting means whereby a blade can be connected to and removed from said carrier, said carrier being movable between a rest position at which a blade connected to said carrier is contained within said handle and a forward position at which the said blade is projected through said opening beyond said handle front end, actuator means operable to cause said carrier movement, a blade sharpener located within said handle adjacent said opening and being operable to engage the cutting edge of the said blade so as to sharpen that edge during movement of said blade through said opening, and sharpener release means which is selectively operable to render said sharpener inoperable.

20. A knife according to claim 19, wherein a said blade is releasably connected to said carrier, and said carrier is removable from said handle through a rear end thereof to permit removal and connection of a said blade respectively from and to said carrier.

21. A knife according to claim 20, wherein a rear end portion of said handle is removable from the main body of the handle to permit movement of said carrier through said rear end.

22. A knife according to claim 21, wherein said rear end portion is slidably connected to said main body for relative movement in a direction transverse to the longitudinal axis of said handle.

23. A knife according to claim 22, wherein snap engaging means acts between said rear end portion and said main body so as to resist removal of said rear end portion from the main body.

24. A retractable blade knife including, a hollow handle, a blade opening at a front end of said handle, a blade carrier mounted within said handle for movement between a rest position at which a blade connected to said carrier is contained within said handle and a forward position at which the said blade is projected through said opening beyond said handle front end, actuator means operable to cause said carrier movement and comprising a lever which is pivotally connected at an inner end to said carrier so as to be movable relative thereto between operative and stored positions, said lever projecting laterally outwards of said handle when in said operative position and being substantially contained within said handle when in said stored position, a blade sharpener located within said handle adjacent said opening and being engageable with the cutting edge of a said blade so as to sharpen that edge as said blade is moved with said carrier, and stop means mounted on said handle for movement between a stop position at which it is operative to prevent movement of a said blade forwardly through said opening and a release position at which it is not so operative, and release means which is operable to move said stop means from said stop position to said release position.

25. A knife according to claim 24, wherein said lever projects outwardly through an elongate opening in said handle when in said operative position, and the outer end of the lever is engageable with respective opposite ends of said opening when in the stored position according to whether said carrier is in the rest or forward position respectively.

26. A retractable blade knife including, a hollow handle, a blade opening at a front end of said handle, a blade carrier mounted within said handle for movement between a rest position at which a blade connected to said carrier is contained within said handle and a forward position at which the said blade is projected through said opening beyond said handle front end, connecting means whereby a said blade can be connected to and removed from said carrier, actuator means operable to cause said carrier movement, a blade sharpener located within said handle adjacent said opening and being operable to engage the cutting edge of the said blade so as to sharpen that edge during movement of said blade through said opening, releasable locking means which is operable to prevent movement of said carrier out of said forward position said releasable locking means formed at least in part by said actuator means and releasable stop means which is automatically operable to prevent movement of said carrier from said rest position to said forward position.

27. A knife according to claim 26, wherein a storage compartment for at least one spare blade is provided within said handle.

* * * * *